US007121647B2

(12) United States Patent
Smoot et al.

(10) Patent No.: US 7,121,647 B2
(45) Date of Patent: Oct. 17, 2006

(54) METHOD OF APPLYING AN ENCAPSULANT MATERIAL TO AN INK JET PRINTHEAD

(75) Inventors: Mary C. Smoot, Lexington, KY (US); Jeanne M. Saldanha Singh, Lexington, KY (US); Paul T. Spivey, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 238 days.

(21) Appl. No.: 10/679,070

(22) Filed: Oct. 2, 2003

(65) Prior Publication Data

US 2005/0073552 A1 Apr. 7, 2005

(51) Int. Cl.
*B41J 2/16* (2006.01)

(52) U.S. Cl. ..... 347/50

(58) Field of Classification Search ..... 347/50, 347/57–59, 63, 87; 174/263; 29/840, 841, 29/25.29, 25.35; 435/66; 228/248.1, 180.22
See application file for complete search history.

(56) References Cited

U.S. PATENT DOCUMENTS

| | | | | |
|---|---|---|---|---|
| 4,680,859 | A | 7/1987 | Johnson | 29/611 |
| 4,935,750 | A | 6/1990 | Hawkins | 347/63 |
| 5,435,961 | A | 7/1995 | Micciche | 264/319 |
| 5,450,113 | A | 9/1995 | Childers et al. | 347/87 |
| 5,478,700 | A | 12/1995 | Gaynes et al. | 430/35 |
| 5,515,089 | A | 5/1996 | Herko et al. | 347/63 |
| 5,538,586 | A | 7/1996 | Swanson et al. | 156/309.6 |
| 5,539,153 | A | 7/1996 | Schwiebert et al. | 174/260 |
| 5,596,172 | A | 1/1997 | Raskin et al. | 174/52.4 |
| 5,627,108 | A | 5/1997 | Alibocus et al. | 228/175 |
| 5,669,970 | A | 9/1997 | Balog et al. | 118/213 |
| 5,736,998 | A | 4/1998 | Caren et al. | 347/45 |
| 5,807,606 | A | 9/1998 | Mould et al. | 427/10 |
| 5,905,513 | A | 5/1999 | Brandon et al. | 347/33 |
| 6,010,208 | A | 1/2000 | Powers et al. | |
| 6,067,709 | A | 5/2000 | Godin et al. | 29/841 |
| 6,076,912 | A | 6/2000 | Murthy | 347/18 |
| 6,089,151 | A | 7/2000 | Cobbley et al. | 101/127 |
| 6,098,257 | A | 8/2000 | Koido et al. | 29/25.35 |
| 6,113,216 | A * | 9/2000 | Wong | 347/50 |
| 6,244,696 | B1 | 6/2001 | Tran et al. | 347/87 |
| 6,253,675 | B1 | 7/2001 | Mayer | 101/127.1 |
| 6,260,957 | B1 | 7/2001 | Corley, Jr. et al. | |
| 6,267,472 | B1 | 7/2001 | Maher et al. | 347/65 |
| 6,290,340 | B1 | 9/2001 | Kitahara et al. | 347/70 |
| 6,328,423 | B1 | 12/2001 | Wong et al. | 347/50 |
| 6,361,152 | B1 | 3/2002 | Fujisawa | 347/68 |
| 6,371,017 | B1 | 4/2002 | Yamazaki et al. | 101/129 |
| 6,386,434 | B1 * | 5/2002 | Wong | 228/248.1 |
| 6,409,312 | B1 | 6/2002 | Mrvos et al. | |

(Continued)

FOREIGN PATENT DOCUMENTS

EP 0867293 A2 9/1998

(Continued)

*Primary Examiner*—K. Feggins
(74) *Attorney, Agent, or Firm*—Thompson Hine LLP

(57) ABSTRACT

A stencil printed encapsulant material is provided for use in protecting electrical components in thermal ink jet printhead cartridges. A method of applying an encapsulant material to an ink jet print cartridge by stencil printing is also provided. The method includes providing a stencil having at least one aperture, providing an ink jet cartridge and stencil printing an encapsulant material onto a portion of the ink jet print cartridge thereby forming a layer of encapsulant material to protect electrical components or other printhead components.

25 Claims, 4 Drawing Sheets

U.S. PATENT DOCUMENTS

| | | | | |
|---|---|---|---|---|
| 6,439,698 | B1 | 8/2002 | Patil | |
| 6,495,199 | B1 | 12/2002 | Kaiser et al. | 427/98.5 |
| 6,508,170 | B1 | 1/2003 | Katsuoka et al. | 101/455 |
| 6,649,403 | B1 * | 11/2003 | McDevitt et al. | 435/288.5 |
| 2001/0015744 | A1 | 8/2001 | Feinn et al. | 347/87 |
| 2001/0043252 | A1 | 11/2001 | Feder et al. | 347/50 |
| 2002/0051042 | A1 | 5/2002 | Takagi et al. | 347/72 |
| 2002/0101482 | A1 | 8/2002 | Cook et al. | |
| 2002/0105562 | A1 | 8/2002 | Miyagawa et al. | 347/56 |
| 2002/0128340 | A1 | 9/2002 | Young et al. | 522/1 |
| 2002/0185482 | A1 | 12/2002 | Cobb et al. | 219/209 |
| 2003/0097941 | A1 | 5/2003 | Rossmeisl et al. | 101/129 |
| 2004/0089171 | A1 | 5/2004 | Jiang et al. | 101/128.7 |

FOREIGN PATENT DOCUMENTS

| | | | |
|---|---|---|---|
| EP | 0867293 | A3 | 11/1998 |
| EP | 0888891 | A2 | 1/1999 |

* cited by examiner

METHOD OF APPLYING AN ENCAPSULANT MATERIAL TO AN INK JET PRINTHEAD

FIELD OF THE INVENTION

The present invention relates to ink jet printers and, more particularly, to a method of applying an encapsulant material to an ink jet printhead by stencil printing.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge orifice. A plurality of chambers, each provided with a single heating element, are provided in the printer's printhead. The printhead typically comprises the heater chip and a nozzle plate having a plurality of the discharge orifices formed therein. The printhead forms part of an ink jet print cartridge which also comprises an ink-filled container.

The resistors are individually addressed with an energy pulse to momentarily vaporize the ink and form a bubble which expels an ink droplet. A flexible circuit is used to provide a path for energy pulses to travel from a printer energy supply circuit to the printhead. The flexible circuit includes a substrate portion and a plurality of traces located on the substrate portion. The traces have end sections which extend out from the substrate portion. The extending sections are coupled to bond pads on the printhead. Typically, there is a first row of coupled bond pads and trace sections and an opposing, second row of coupled bond pads and trace sections.

It is known in the art to form a barrier layer over each row of coupled bond pads and extending trace sections. One known process for forming such a barrier layer involves dispensing an encapsulant material onto the coupled bond pads and trace sections using a discharge needle. The final height of the barrier layer relative to the nozzle plate typically is undesirably high. As a result, a paper substrate, which receives the ejected ink droplets, is spaced an increased distance from the printhead orifice plate. Consequently, misdirected ink droplets reach the paper substrate at locations which are spaced a greater distance from their intended contact points than if the paper substrate were located closer to the printhead orifice plate. The excessive height of the barrier layer is further problematic as it makes it more difficult to apply a length of sealing tape to the printhead so as to seal the printhead orifices from ink leakage until the print cartridge is installed for use in a printer. Another potential problem associated with dispensing an encapsulant material with a discharge needle relates to improper location. Dispensing encapsulant in the wrong locations can result in unacceptable product because the encapsulant fails to provide the necessary coverage for the electrical components on the print cartridge.

Commonly assigned U.S. Pat. No. 6,439,698 describes a dual curable encapsulating material used to protect electronic components of an ink jet printhead. The encapsulant is applied to the electrical connections preferably in the form of a bead.

Commonly assigned EP 0 867 293 A3 describes a method of forming a barrier layer over sections in a flexible circuit using an encapsulant material applied from a dispensing needle having an oval discharge orifice.

SUMMARY OF THE INVENTION

The present invention provides a method of applying an encapsulant material to an ink jet printhead by stencil printing and an ink jet printhead for an ink jet print cartridge produced thereby. In accordance with one aspect of the invention, a method of applying an encapsulant material to an ink jet print cartridge is disclosed. The method comprises providing a compliant stencil having at least one aperture, providing an ink jet cartridge having an outer portion; and stencil printing an encapsulant material onto the outer portion of the ink jet print cartridge thereby forming a layer of encapsulant material. The ink jet print cartridge may include a flexible circuit, a heater chip and at least one electrical connection between the flexible circuit and the heater chip, wherein the encapsulant encapsulates the at least one electrical connection.

In accordance with certain aspects of the invention, the method of applying the encapsulant by stencil printing includes aligning the stencil with a specific position on the print head cartridge such that an aperture aligns with the electrical connections to be encapsulated, depositing the encapsulant material on the stencil and extruding the encapsulant material through the aperture and onto the outer portion of the ink jet print cartridge containing the electrical connections. In accordance with another aspect of the invention, the method may also include applying the encapsulant by stencil printing to other portions of the printhead such as the edges of the TAB flex circuit.

A method for protecting electrical traces on a flexible circuit and connections between the traces and a heater chip/nozzle plate assembly for an ink jet printer is also provided. The method includes providing a stencil having one or more apertures, applying an encapsulant material through the apertures onto the electrical traces and the connections between the traces and the heater chip/nozzle plate assembly. The method may utilize a stencil made of polyimide, fluoropolymer coated polyimide, stainless steel or combinations thereof. In accordance with certain aspects of the invention, the method includes aligning the stencil such that the apertures align with the electrical traces and the connections between the traces and the heater chip/nozzle plate assembly, depositing the encapsulant material on the stencil and extruding the encapsulant material through the apertures and onto the electrical traces and the connections between the traces and the heater chip/nozzle plate assembly thereby forming a layer of encapsulant material.

In accordance with another aspect of the invention, an ink jet print cartridge including a stencil printed encapsulant material is disclosed. The ink jet print cartridge in accordance with this aspect of the invention includes a flexible circuit including electrical traces, a heater chip/nozzle plate assembly and electrical connections between the traces and the heater chip/nozzle plate assembly. A stencil printed layer of an encapsulant material encapsulates the electrical connections, wherein the barrier layer has a height of from about 0.001 to about 0.050 inches, more particularly from about 0.002 to about 0.015 inches.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

All documents cited are, in relevant part, incorporated herein by reference; the citation of any document is not to be construed as an admission that it is prior art with respect to the present invention.

Figure 1:
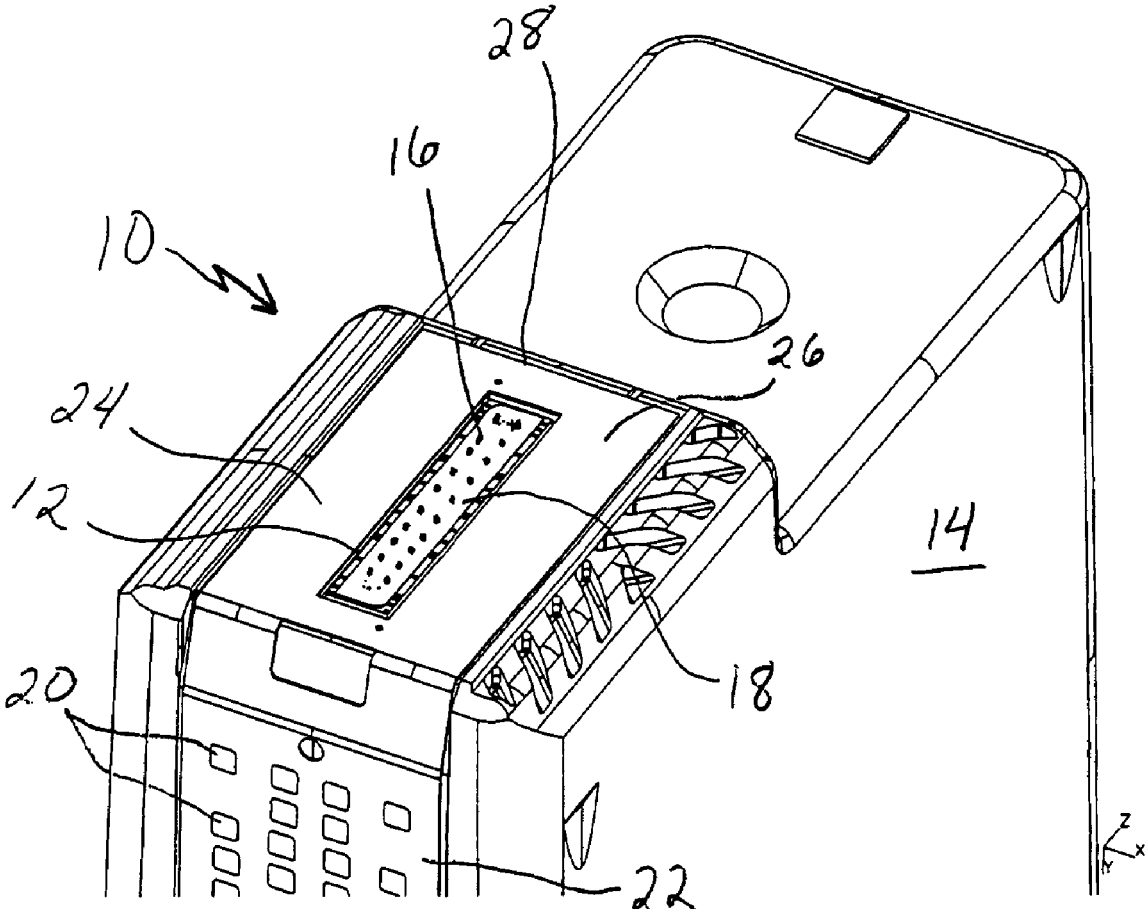
FIG. 1 is a perspective view of a portion of an ink jet print cartridge according to one aspect of the invention.

With reference to FIG. 1, there is shown, in perspective view, an ink jet print cartridge 10 including a heater chip/nozzle plate assembly 12 attached to a cartridge body 14. The cartridge body 14 is an ink-filled polymeric container containing one or more inks for feeding ink to the heater chip/nozzle plate assembly 12 for ejection of ink toward a print media from nozzle holes 16 on nozzle plate 18. Each ink jet print cartridge 10 may contain a single color ink, such as black, cyan, magenta or yellow or may contain multiple colors of ink using a plurality of heater chip/nozzle plate assemblies 12. In the illustration shown in FIG. 1, the ink jet print cartridge 10 contains one heater chip/nozzle plate assembly 12 for ejecting one color of ink.

In order to control the ejection of ink from the nozzle holes 16, the heater chip/nozzle plate assembly 12 is electrically connected to a print controller in the printer to which the print cartridge 10 is attached. Connections between the print controller and the print cartridge are provided by contact pads 20 which are disposed on a first portion 22 of a flexible circuit or tape automated bonding (TAB) circuit 24. Flexible circuits and TAB circuits are resilient polymeric films such as polyimide films 24 which contain electrical traces thereon for conducting electrical signals from a source to a device connected to the traces of the flexible or TAB circuit 24. Accordingly, a second portion 26 of the flexible circuit or TAB circuit 24 is disposed on the operative side 28 of the cartridge body 14. The back side of the flexible circuit or TAB circuit 24 typically contains electrical traces which provide electrical continuity between the contact pads 20 and the heater chip/nozzle plate assembly 12 for controlling the ejection of ink from the nozzle plate 18. Electrical TAB bond or wire bond connections are made between the electrical traces and the heater chip/nozzle plate assembly 12 as described in more detail below.

Figure 2:
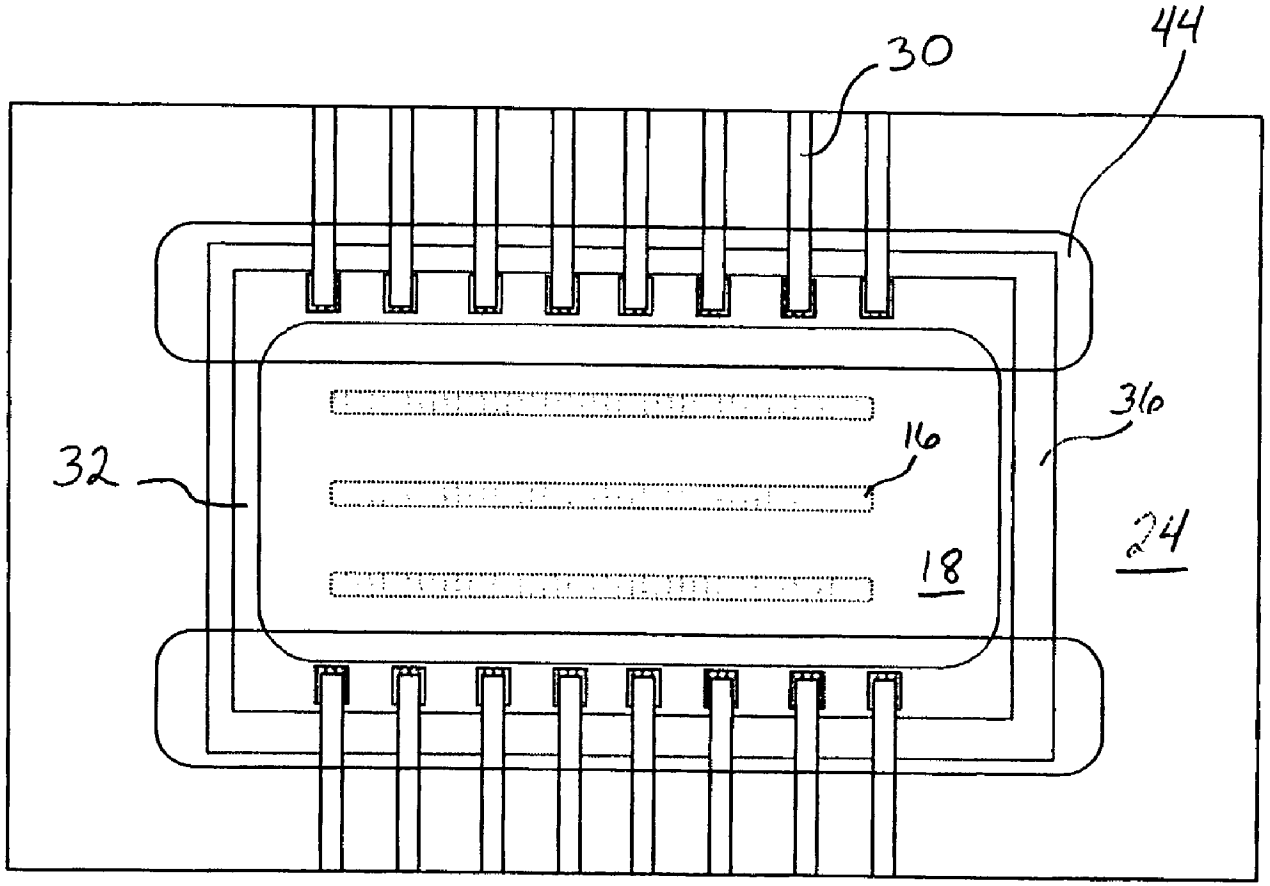
FIG. 2 is a plan view of a portion of an ink jet print cartridge containing an encapsulant material applied in accordance with one aspect of the invention.
Figure 3:
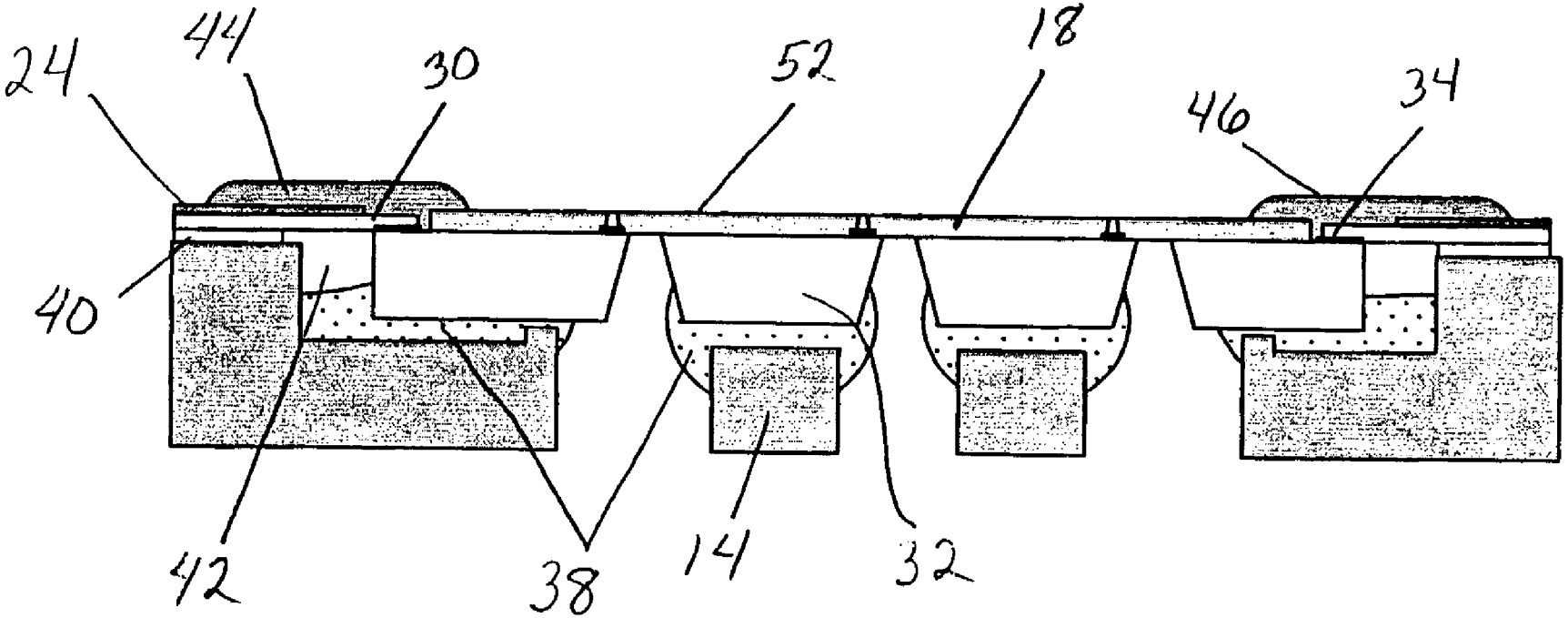
FIG. 3 is a cross-sectional side view of a portion of an ink jet print cartridge according to one aspect of the invention.
Figure 4:
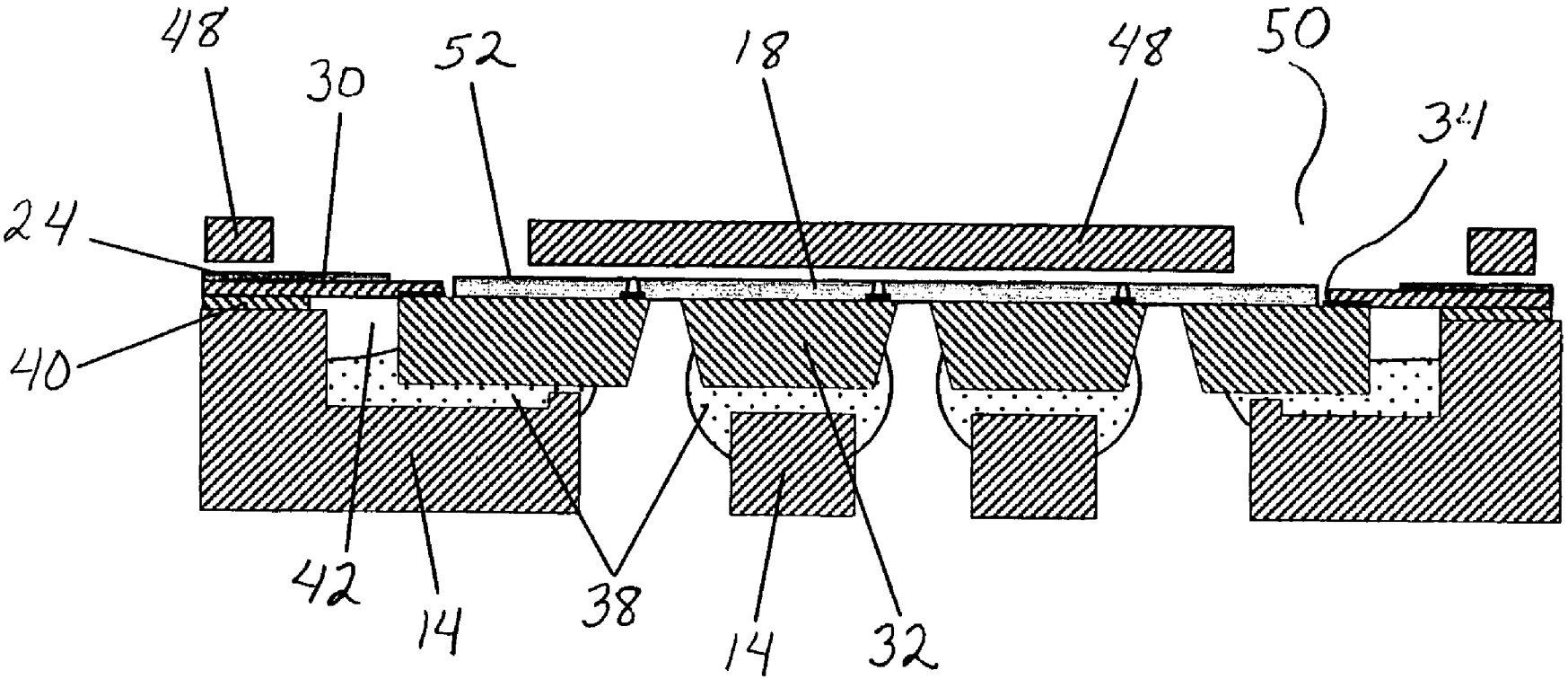
FIG. 4 is a cross-sectional view of a stencil aligned with an ink jet print cartridge in accordance with one aspect of the invention.

Connections between the flexible circuits or TAB circuits 24 and the heater chip/nozzle plate assembly 12 are shown in detail by reference to FIGS. 2, 3 and 4. As described above, the flexible or TAB circuits 24 contain electrical traces 30 which are electrically connected to a heater chip 32. The heater chip 32 contains resistors and/or other electronic devices for inducing ejection of ink through nozzle holes 16 of a nozzle plate 18 toward a print media, typically paper. Connection pads (not shown) on the flexible or TAB circuits 24 are connected to bond pads 34 on the heater chip 32 either by TAB bonding techniques or by use of wires using a wire bonding procedure.

As shown in FIG. 3, the heater chip 32 is attached to the cartridge body 14, preferably in a chip pocket. Prior to attaching the chip 32 to the cartridge body 14, a nozzle plate 18 is attached to the chip 32. The heater chip/nozzle plate assembly 12 in FIG. 1 refers to the assembly provided by the heater chip 32 attached to the nozzle plate 18.

The chip 32 and nozzle plate 18 may be attached using any art recognized bonding techniques including a thermo compression bonding technique. The nozzle plate 18 may be formed from a polymeric material such as polyimide, polyester, fluorocarbon polymer, or polycarbonate. Examples of commercially available nozzle plate materials include polyimide materials available under the trademarks UPILEX and KAPTON available from Ube (of Japan) and E.I. DuPont de Nemours & Co., respectively.

An adhesive (not shown) may be used to secure the nozzle plate 18 to the heater chip 32. The adhesive may be a heat curable adhesive such a B-stage thermal cure resin, including, but not limited to phenolic resins, resorcinol resins, epoxy resins, ethylene-urea resins, furane resins, polyurethane resins and silicone resins. The adhesive is preferably cured before attaching the chip to the cartridge body and the adhesive preferably has a thickness ranging from about 1 to about 25 microns.

After bonding the nozzle plate 18 and chip 32 together, the chip/nozzle plate assembly 12 is attached to the cartridge body 14 in chip pocket 36 using a die attach adhesive 38. The die attach adhesive 38 is preferably an epoxy adhesive such as a die attach adhesive available from Emerson & Cuming of Monroe Township, N.J. under the trade name ECCOBOND 3193-17.

Once the chip/nozzle plate assembly 12 in FIG. 1 is attached to the cartridge body 14, the flexible circuit or TAB circuit 24 is attached to the cartridge body 14 using a heat activated or pressure sensitive adhesive 40 as shown in FIG. 4. Examples of useful adhesives 40 include, but are not limited to, phenolic butyral adhesives, acrylic based pressure sensitive adhesives such as AEROSET 1848 available from Ashland Chemicals of Ashland, Ky. and phenolic blend adhesives such as SCOTCH WELD 583 available from 3M Corporation of St. Paul, Minn. The adhesive 40 typically has a thickness ranging from about 25 to about 200 microns.

In accordance with another aspect of the invention, the ink jet print cartridge 10 can be produced by applying heat activated or pressure sensitive adhesive 40 to the cartridge body 14 and dispensing die bond adhesive 38 in the cartridge body 14. Chip/nozzle plate assembly 12 is attached to the flexible circuit 24 to form a circuit assembly. The circuit assembly is attached to the cartridge body 14 by placing the circuit assembly on the cartridge body 14 such that the flexible circuit contacts the adhesive 40 and the chip/nozzle plate assembly 12 contacts and displaces some of the die bond adhesive 38. Underfill material (42) may be dispensed directly above the gap between the flexible circuit 24 and the chip 32 to fill up a voided area.

In order to protect the bond pads 34 and electrical traces 30 from ink corrosion, a protective overcoat layer or encapsulant 44 in FIG. 2 is applied to the traces 30 and bond pads 34. In accordance with the present invention the encapsulant is applied by stencil printing to provide a thin, consistent and smooth layer 46 of encapsulant 44. During the stencil printing process in accordance with certain embodiments, a stencil 48 having one or more apertures 50 corresponding to the locations on the inkjet print cartridge 10 requiring the protective overcoat layer is aligned with a specific location on the printhead. In accordance with certain embodiments, an automated stencil printing device can be used which provides the proper stencil 48 for a specific part and pattern of encapsulant 44. The cartridge 10 is properly located such that the apertures 50 in the stencil 48 correspond to the portions of the cartridge 10 requiring encapsulation. The cartridge 10 may be positioned by the external datums on the ink jet printhead body 14 to verify proper alignment. Alternatively, a vision system can be used to align the stencil 48 with the print cartridge 10. Fiducials on the stencil 48 are aligned to the fiducials on the print cartridge 10 thereby positioning the stencil 48 into proper alignment with the print cartridge 10 so that encapsulant can be stencil printed on to the print cartridge 10.

Once the print cartridge 10 has been properly aligned with the stencil 48, the encapsulant 44 is deposited on the stencil 48. A squeegee may be used to move the encapsulant material across the upper surface of the stencil thereby forcing the encapsulant material through the apertures 50 in the stencil 48 into contact with and covering the bond pads 34 and wires or traces 30. As the squeegee is moved across the stencil, the encapsulant 44 tends to roll in front of the blade, which desirably causes mixing and shear thinning of the encapsulant so as to attain desired viscosity to facilitate filling of the apertures 50 in the stencil 48. The encapsulant may be replenished on the stencil 48 with an automatic dispensing system.

The travel rate of the squeegee is the print speed. In accordance with one particular embodiment, the print speed typically ranges from about 1 to 10 inches/second (25.4 to 254 mm/s). Target print speed is 3 inches per second (76 mm/s). The force per unit length of squeegee on the printhead typically is about 1.1 lb/inch (0.026 Kg/mm) in accordance with one embodiment. The tolerance range is 0.1 lb/inch to 2 lb/inch.

The squeegee contact angle with the stencil typically ranges from about 35 to 75 degrees. The target condition is about 50 degrees.

It is preferred that the layer 46 of encapsulant 44 applied over the connections 30 and 34 not extend too far above a plane defined by the surface 52 of the nozzle plate 20 (FIG. 3). Accordingly, in accordance with particular embodiments, the height of coating layer 46 above the nozzle plate 20 surface 52 ranges from about 0.001 to about 0.050 inches, more particularly from about 0.002 to about 0.015 inches, and in certain embodiments from about 0.003 to about 0.009 inches.

In accordance with certain embodiments of the present invention, the encapsulant material could utilize one or more of the following cure mechanisms: thermal cure, photosensitive cure, microwave cure, IR cure, moisture cure, and/or room temperature cure. In accordance with a thermal cure system, after applying the encapsulant 44 to the exposed areas of the electrical traces 30 and bond connections 34, the encapsulant 44 is exposed to a temperature in excess of about 80° C., most preferably a temperature in the range of from about 80 to about 150° C. for a period of time ranging from about 5 minutes to about 2 hours. In accordance with a photosensitive cure system, after applying the encapsulant 44 to the exposed areas of the electrical traces 30 and bond connections 34, the encapsulant 44 is exposed to actinic radiation to cure portions of the encapsulant 44 which are not shielded or hidden from the radiation source followed by a thermal bake cycle. Suitable actinic radiation includes visible light, ultraviolet light, electron beam, x-ray, gamma-ray, beta-ray and the like. A preferred actinic radiation for curing the encapsulant 44 is UV radiation having a wavelength in the range of from about 200 to about 450 nanometers.

The post bake cycle aids in driving off any residual solvents or low molecular weight fractions from any portion of the encapsulant material 44 or to provide additional crosslinking. It is preferred to bake the encapsulant material generally at the same time various other adhesives are cured such as the adhesive 38 used to attach the nozzle plate/chip assembly 12 to the cartridge body 14. During the thermal curing cycle, the encapsulant is preferably exposed to a temperature in excess of about 80° C., most preferably a temperature in the range of from about 80 to about 150° C. for a period of time ranging from about 5 minutes to about 2 hours.

The encapsulant 44 preferably has a viscosity and shear thinning capability which enables placement of the encapsulant 44 on the connections in window 36 such that it effectively coats the traces 30 or wires and encapsulates and overlaps the ends of the nozzle plate 18 and flexible circuit or TAB circuit 24. If the viscosity of the encapsulant 44 is too high, void spaces may occur in window 36 so that the connections and ends are not effectively protected from ink corrosion. If the encapsulant 44 has too low a viscosity, it will be difficult to provide the coating layer 46 of encapsulant 44 which will remain in the desired location until curing of the encapsulant 44 is complete. Accordingly, the viscosity of the encapsulant 44 preferably ranges from about 25,000 to about 240,000 centipoise with a thixotropic index of from about 1 to about 10, more specifically from about 80,000 centipoise to about 180,000 centipoise with a thixotropic index of about 1.5 to about 3.0. Viscosity and thixotropic index are measured on a Brookfield cone and plate viscometer at 25° C. Viscosity is measured at a shear rate of 2.0 $s^{-1}$ and thixotropic index is measured at shear rates of 2.0 $s^{-1}$ and 20.0 $s^{-1}$. The thixotropic index refers to the ratio of the encapsulant's viscosity at 2.0 $s^{-1}$ to the viscosity at 20.0 $s^{-1}$ and provides a measure of the shear thinning characteristics of the encapsulant.

The encapsulant material 44 is typically characterized by adhesion to the polymeric materials used in the construction of various components of the ink jet print cartridge. Examples of such polymeric materials include, but are not limited to, polyimide materials such as those commercially available from E.I. DuPont de Nemours & Co. under the trademark KAPTON and from Ube under the trademark UPILEX.

Preferably, the encapsulant material 44 is resistant to ink and is capable of adequately protecting the exposed areas of the electrical traces 30 and bond connections 34. In accordance with certain embodiments, the encapsulant material 44 comprises a polymeric material which, after it has substantially solidified or cured, is capable of forming an effective mechanical and chemical protective barrier layer. In accordance with this embodiment, the smooth layer 46 of encapsulant 44 protects the bond connections from corrosion due to exposure to ink. The layer further protects the bond connections and exposed areas of the electrical traces 30 from damage caused by a conventional polymeric wiper (not shown) which forms part of the printer and moves across the nozzle plate 18 so as to remove ink therefrom. The encapsulant material 44 in accordance with certain embodiments of the invention has a glass transition temperature of greater than or equal to about 60° C. Specific examples of the encapsulant materials 44 useful herein include a thermal cure epoxy adhesive such as Epibond 7275 from Huntsman Advanced Chemicals, Inc., EMS 502-39-1 from EMS Inc., a UV radiation curable urethane acrylate material such as ECCOBOND® UV9000 which is commercially available from Emerson & Cuming, and Emcast 708 available from EMI Inc. Encapsulant materials not specifically set out herein may also be used.

The stencil 48 can be made of various materials. Particularly useful examples include, but are not limited to plastics and stainless steels. Specific examples of useful plastics include but are not limited to, polyimides and fluoropolymer coated polyimides. The stencil thickness typically varies from about 0.001 to about 0.015 inches, more particularly from about 0.003 to about 0.009 inches.

Various materials can be used to produce the squeegee used in accordance with the present invention. Examples of useful materials include, but are not limited to, polyethylene, polyurethane, stainless steel and polytetrafluoroethylene (available under the trademark TEFLON® from E.I. DuPont de Nemours & Co.). The squeegee blades typically have a hardness of between about 0 to about 70 durometer, more typically about 50 durometer, on a Shore D scale or a Shore A equivalent.

Stencil printing offers a number of advantages over dispensing systems. The ability to apply a more consistent layer of encapsulant at precise locations increases yields and productivity. Taping the printhead is more easily accomplished with stencil printed encap due to its uniformity in location and height. Maintenance of the printhead between uses is improved with stencil printed encapsulant. The wiper which runs across the printhead cleans it more thoroughly with the lower, more uniform encapsulant. Multiple locations may be stencil printed in a single operation thereby reducing production costs. For example, a stencil can be used to seal the tab circuit to the cartridge at the same time it provides encapsulant over the electrical connections. The encapsulant can be provided in a number of configurations. Encapsulant can be stencil printed in controlled, intricate designs, and in larger areas.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A method of applying an encapsulant material to an ink jet print cartridge comprising the steps of:

providing a compliant stencil having at least one aperture;

providing an ink jet cartridge having an outer portion; and stencil printing an encapsulant material onto the outer portion of the ink jet print cartridge thereby forming a layer of encapsulant material.

2. The method of claim 1 wherein said ink jet print cartridge comprises:

a flexible circuit, a heater chip and at least one electrical connection between the flexible circuit and the heater chip, wherein said outer portion of the ink jet print cartridge comprises the at least one electrical connection.

3. The method of claim 2 wherein said flexible circuit includes at least one electrical trace and said heater chip includes at least one bond pad, and said at least one electrical connection comprises said at least one electrical trace coupled to said at least one bond pad.

4. The method of claim 3 wherein said at least one electrical trace is TAB bonded to said at least one bond pad.

5. The method of claim 1 wherein said stencil is made of a material selected from the group consisting of plastic, polyimide, fluoropolymer coated polyimide, stainless steel and combinations thereof.

6. The method of claim 1 wherein said stencil has a thickness of from about 0.001 to about 0.015 inches.

7. The method of claim 1 wherein said step of stencil printing comprises:

aligning the stencil with a specific position on the print head cartridge such that the at least one aperture aligns with the outer portion of the ink jet print cartridge;

depositing the encapsulant material on the stencil; and extruding the encapsulant material through the at least one aperture and onto the outer portion of the ink jet print cartridge.

8. The method of claim 1 wherein the encapsulant material comprises a polymeric material.

9. The method of claim 8 wherein said polymeric material is curable by actinic radiation, thermal energy or by a combination of actinic radiation and thermal energy.

10. The method of claim 9 further comprising:

exposing the stencil printed layer of encapsulant material to either actinic radiation, thermal energy or a combination thereof to substantially cure the polymeric material.

11. The method of claim 1 wherein the encapsulant material has a viscosity of from about 25,000 to about 240,000 centipoise as measured on a Brookfield cone and plate viscometer at 25° C. at a shear rate of 2.0 $s^{-1}$ and a thixotropic index of from about 1 to about 10 as measured at 2.0 $s^{-1}$ and 20.0 $s^{-1}$.

12. The method of claim 1 wherein the stencil printed layer of encapsulant material has a height from about 0.001 to about 0.015 inches.

13. An ink jet print cartridge including an encapsulant material applied in accordance with claim 1.

14. A method for protecting electrical traces on a flexible circuit and connections between the traces and one or more heater chip/nozzle plate assemblies for an ink jet printer comprising the steps of:

providing a stencil having at least one aperture;

applying an encapsulant material through the at least one aperture onto the electrical traces and the connections between the traces and the one or more heater chip/nozzle plate assemblies.

15. The method of claim 14 wherein said stencil is made of a material selected from the group consisting of plastic, polyimide, fluoropolymer coated polyimide, stainless steel and combinations thereof.

16. The method of claim 14 wherein said stencil has a thickness of from about 0.001 to about 0.015 inches.

17. The method of claim 14 wherein said step of applying an encapsulant material comprises:

aligning the stencil such that the at least one aperture aligns with the electrical traces and the connections between the traces and the one or more heater chip/nozzle plate assemblies;

depositing the encapsulant material on the stencil; and extruding the encapsulant material through the at least one aperture and onto the electrical traces and the connections between the traces and the one or more heater chip/nozzle plate assemblies thereby forming a layer of encapsulant material.

18. The method of claim 14 wherein the encapsulant material comprises a polymeric material.

19. The method of claim 18 wherein said polymeric material is curable by actinic radiation, thermal energy or by a combination of actinic radiation and thermal energy.

20. The method of claim 19 further comprising:

exposing the stencil printed layer of encapsulant material to either actinic radiation, thermal energy or a combination thereof to substantially cure the polymeric material.

21. The method of claim 14 wherein the encapsulant material has a viscosity of from about 25,000 to about 240,000 centipoise as measured on a Brookfield cone and plate viscometer at 25° C. at a shear rate of 2.0 $s^{-1}$.

22. The method of claim 14 wherein the stencil printed layer of encapsulant material has a height from about 0.001 to about 0.015 inches.

23. An ink jet print cartridge comprising:

a flexible circuit including electrical traces;

a heater chip/nozzle plate assembly comprising a heater chip and a nozzle plate; and electrical connections between the traces and the heater chip/nozzle plate assembly, wherein a stencil printed layer comprising an encapsulant material encapsulates the electrical connections, the barrier layer having a height of from about 0.001 to about 0.015 inches.

24. The ink jet print cartridge of claim 23 wherein the height of the layer is from about 0.003 to about 0.009 inches.

25. The ink jet print cartridge of claim 23 wherein the encapsulant material comprises a thermal cure epoxy adhesive.

* * * * *